US007357183B2

(12) United States Patent
Gazewood

(10) Patent No.: US 7,357,183 B2
(45) Date of Patent: Apr. 15, 2008

(54) MAGNETIC FISHING TOOL AND METHOD

(75) Inventor: Michael J. Gazewood, Hye, TX (US)

(73) Assignee: Venturi Oil Tools, Hye, TX (US)

( * ) Notice: Subject to any disclaimer, the term of this patent is extended or adjusted under 35 U.S.C. 154(b) by 126 days.

(21) Appl. No.: 11/222,647

(22) Filed: Sep. 9, 2005

(65) Prior Publication Data

US 2007/0102161 A1 May 10, 2007

(51) Int. Cl.
*E21B 31/06* (2006.01)

(52) U.S. Cl. ..... 166/301; 166/98; 166/99

(58) Field of Classification Search ..... None
See application file for complete search history.

(56) References Cited

U.S. PATENT DOCUMENTS

| | | | |
|---|---|---|---|
| 1,094,106 | A | 4/1914 | White |
| 2,431,361 | A | 11/1947 | Athy |
| 2,451,231 | A | 10/1948 | Manegold |
| 2,522,294 | A | 9/1950 | Noble |
| 2,556,849 | A | 6/1951 | Nolley et al. |
| 2,595,632 | A | 5/1952 | Bivings et al. |
| 2,657,752 | A | 11/1953 | Ballew et al. |
| 2,668,077 | A | 2/1954 | Kirby, II |
| 2,700,567 | A | 1/1955 | Fortenberry |
| 2,709,104 | A | 5/1955 | Gibbs |
| 2,729,494 | A | 1/1956 | Trowbridge |
| 2,734,767 | A | 2/1956 | Donham |
| 2,778,669 | A | 1/1957 | Goodwin |
| 2,789,790 | A | 4/1957 | Kirby, II |
| 2,830,663 | A | 4/1958 | Kirby, II |
| 2,830,664 | A | 4/1958 | Kirby, II |
| 2,833,353 | A | 5/1958 | Walton et al. |
| 2,857,970 | A | 10/1958 | Hopkins |
| 2,891,621 | A | 6/1959 | Walton et al. |
| 2,918,323 | A | 12/1959 | Coffee |
| 3,011,819 | A | 12/1961 | Moseley, Jr. |
| 3,203,491 | A | 8/1965 | Turley |
| 3,378,089 | A | 4/1968 | Marsh |
| 3,520,359 | A | 7/1970 | Ehrlich |
| 4,059,155 | A | 11/1977 | Greer |
| 4,226,285 | A | 10/1980 | Moseley, Jr. |
| 4,296,822 | A | 10/1981 | Ormsby |
| 5,465,789 | A | 11/1995 | Evans |
| 5,944,100 | A | 8/1999 | Hipp |
| 6,216,787 | B1 | 4/2001 | Ruttley |
| 6,269,877 | B1 | 8/2001 | Zeer et al. |
| 6,308,781 | B2 | 10/2001 | Ruttley |
| 6,354,386 | B1 | 3/2002 | Ruttley |
| 6,357,539 | B1 | 3/2002 | Ruttley |
| 6,439,303 | B1 | 8/2002 | Sorhus et al. |
| 6,491,117 | B2 | 12/2002 | Ruttley |
| 6,629,562 | B1 | 10/2003 | Fidan |
| 6,655,462 | B1 | 12/2003 | Carmichael et al. |
| 2001/0013413 | A1 | 8/2001 | Ruttley |

*Primary Examiner*—Zakiya W. Bates
(74) *Attorney, Agent, or Firm*—C. Dean Domingue; Robert L. Waddell; Ted M. Anthony

(57) ABSTRACT

An apparatus and method for retrieving metal objects. The apparatus includes a housing with an inner part, with the housing having a first wall. The apparatus further includes a sleeve disposed within the housing, with the sleeve being constructed of a non-magnetic conduction material. A magnet is disposed within the sleeve, with the magnet having a north pole and a south pole. The apparatus further includes a container disposed within the sleeve, the container having a second wall. In the most preferred embodiment, the first wall defines a first pathway for magnetic lines of flux for the north pole of the magnet and wherein the second wall defines a second pathway for magnetic lines of flux for the south pole of the magnet so that a toroidal magnetic field is formed about the distal end of the sleeve.

19 Claims, 10 Drawing Sheets

MAGNETIC FISHING TOOL AND METHOD

BACKGROUND OF THE INVENTION

This invention relates to an apparatus for retrieving metal objects. More specifically, this invention relates to a fishing apparatus for retrieving metal objects from a well bore.

In the search for hydrocarbons, an operator will drill a subterranean well bore. The well bore may be cased with a casing string, and thereafter, completed to a hydrocarbon reservoir. As well understood by those of ordinary skill in the art, during the course of drilling, completing, and producing, objects may become lost within the well bore. These objects are known as fish, and as the name implies, operators many times find it highly desirable to retrieve these fish.

Sometimes, the fish may be large metal objects such as packers, plugs, valves, etc. However, smaller objects, such as metal shavings, nuts, bolts, pieces of hand tools, etc, also find there way into the well bore. As well known in the art, very costly well bores may have to be scraped and/or sidetracked due to these types of fish. Hence, operators have utilized various types of tools through the years in order to retrieve the lost objects. One type of tool that has been used is the magnet fishing tool. However, all of the present magnet fishing tools have inherent problems and limitations.

Therefore, there is a need for an apparatus that can be used to retrieve metal objects. There is also a need for a fishing device that can retrieve fish in a well bore. Still further, there is a need for a fishing tool that utilizes a magnetic field in order to retrieve metal objects. These and many other needs will be met by the apparatus herein disclosed.

SUMMARY OF THE INVENTION

A down hole fishing apparatus is disclosed. The apparatus comprises a housing with an inner part and a first wall, and wherein the housing having an open end and a closed end. The apparatus further includes a sleeve disposed within the housing, with the sleeve being constructed of a non-magnetic conduction material, and wherein the sleeve has a proximal end and a distal end. The apparatus will further comprise a magnet disposed within the sleeve, with the magnet having a north pole and a south pole. The apparatus may further include a container disposed within said sleeve, said container having a second wall, wherein said container having a closed end and an open end.

In one preferred embodiment, the first wall defines a first pathway for magnetic lines of flux for the north pole of the magnet and the second wall defines a second pathway for magnetic lines of flux for the south pole of the magnet so that a toroidal magnetic field is formed about the distal end of the sleeve. In the most preferred embodiment, the magnet material is a rare earth permanent magnetic material selected from the group consisting of neodymium, iron boron, sumarium cobalt. Also, the non-magnetic conduction material may be selected from the group consisting of aluminum, copper, brass, plastics and alloys not having iron or tungsten, and the container material may be selected from the group consisting of iron and steel alloys.

In one preferred embodiment, the housing is connected to a wire line string. In another embodiment, the housing is connected to a coiled tubing string.

A method of retrieving a metal object within a well bore is also disclosed. The method includes lowering a fishing apparatus into the well bore on a work string. In the preferred embodiment, the apparatus comprising: a housing with an inner part and a first wall; a sleeve disposed within the housing, with the sleeve being constructed of a non-magnetic conduction material; a magnet disposed within the sleeve, with the magnet having a north pole and a south pole; and a container disposed within the sleeve, with the container having a second wall.

The method further comprises creating a first pathway for magnetic lines of flux for the north pole of the magnet, wherein the first pathway is formed from the first wall of the housing, and creating a second pathway for magnetic lines of flux for the south pole of the magnet, and wherein the second pathway is formed from the second wall of the container. The method further comprises generating a toroidal magnetic field about an end of the sleeve, lowering the fishing apparatus so that the toroidal magnetic field comes into contact with the object, and magnetically coupling the object to the apparatus due to the toroidal magnetic field. The apparatus may be lowered utilizing wire line, coiled tubing, snubbing pipe, or other tubulars.

An advantage of the present invention is the ability of the apparatus to focus the magnetic field in a pattern compatible to well bore fishing applications. In other words, the toroidal magnetic field pattern has an annular cross-sectional area. Yet another advantage is that the magnetic lines of flux are focused in a toroidal shape.

A feature of the present invention is that the magnetic field strength may be varied by changing the size of magnet or the material of the magnet. Still yet another feature is that the operator can effect magnetic field strength by varying size of housing, sleeve and container. Another feature is that the apparatus can be run on wire line, electric line, coiled tubing and other tubulars.

Yet another feature is that the design of the container allows for the shaping of the toroidal shaped magnetic field. Another feature is that the cavity of the container allows for placement of the fishing neck during the fishing operation. Still yet another feature is the container allows for the shaping of the toroidal shaped magnetic field.

DETAILED DESCRIPTION OF THE PREFERRED EMBODIMENTS

Figure 1:
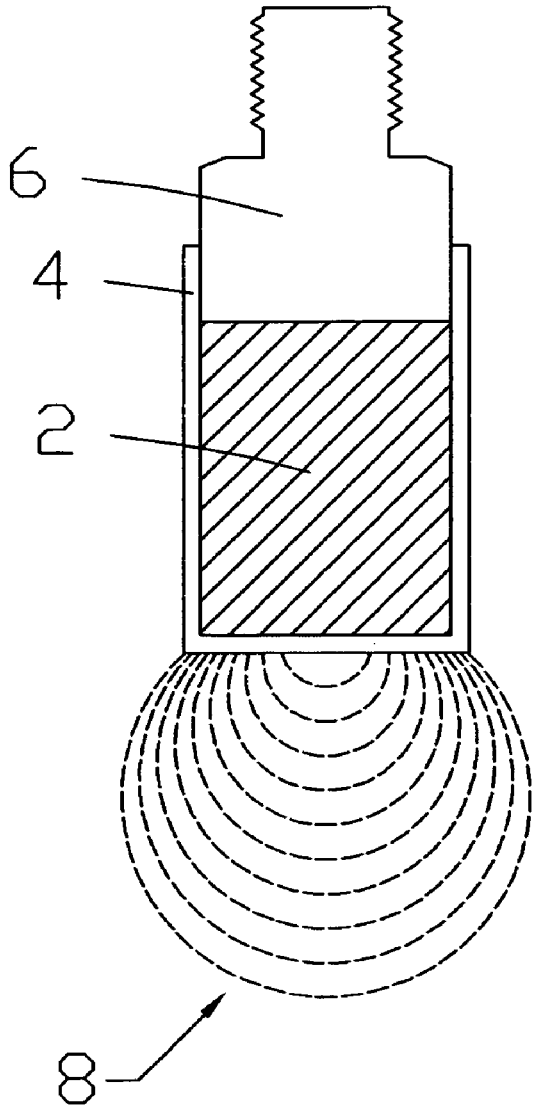
Fig. 1 PRIOR ART
FIG. 1 is a partial cross-sectional view of a prior art magnet.

Referring now to FIG. 1, a partial cross-sectional view of a prior art magnet will now be described. Prior art magnets contained a generally cylindrical magnet 2 that was encased in a cylindrical container 4. The cylindrical container 4 was attached to an adapter sub 6, and wherein the adapter sub 6 can then be attached to a work string, such as wire line, electric line, coiled tubing or other tubulars. FIG. 1 depicts the magnetic lines of flux created by the prior art design, with the magnetic lines of flux being denoted by the numeral 8. As shown in FIG. 1, the magnetic lines of flux emanate in a spherical fashion from the magnet 2.

Figure 2:
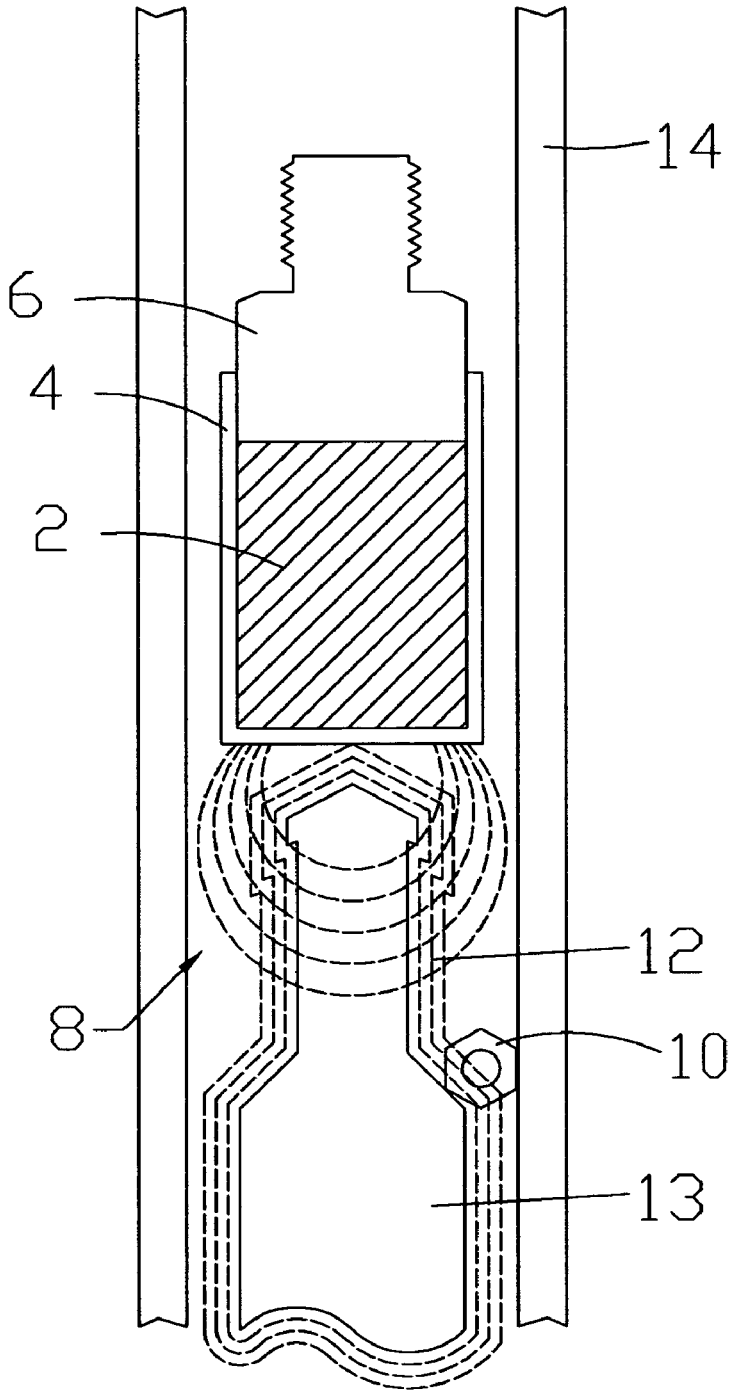
Fig. 2 PRIOR ART
FIG. 2 is a partial cross-sectional view of the prior art magnet of FIG. 1 in the operation of retrieving a down hole fish.

FIG. 2 is a partial cross-sectional view of the prior art tool of FIG. 1 in the operation of retrieving a down hole fish 10. It should be noted that like numbers appearing in the various figures refer to like components. In this case, the down hole fish 10 is a bolt that is positioned on top of a fishing neck 12 of a down hole tool 13 in a well bore 14. As those of ordinary skill in the art will appreciate, the fish 10 will have to be retrieved before the down hole tool 13 can be retrieved. FIG. 2 depicts the prior art magnet 2, and in particular, the prior art magnetic lines of flux. As shown in FIG. 2, the fish 10 will not be able to be retrieved due to the poorly focused magnetic lines of flux 8.

Figure 3:
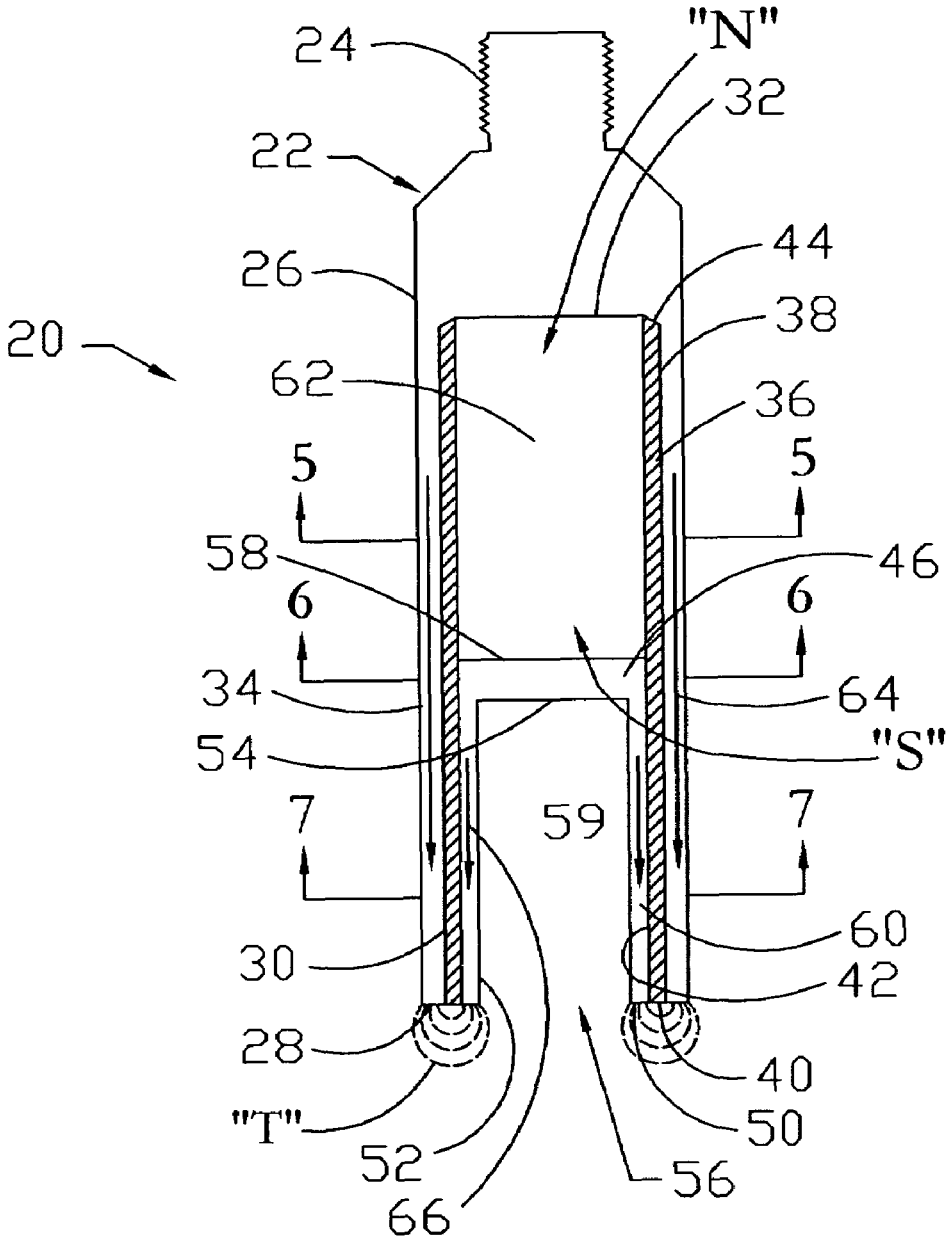
FIG. 3 is a partial cross-sectional view of the preferred embodiment of the down hole apparatus.

Referring now to FIG. 3, a partial cross-sectional view of the preferred embodiment of the down hole apparatus 20 will now be described. The apparatus 20 contains a housing 22 that is generally cylindrical. The housing 22 includes the external threads 24 which in turn extend to the outer surface 26. The outer surface 26 terminates at the radial end 28. The housing 22 contains an inner diameter portion 30, and wherein the inner diameter portion 30 extends to the radial surface 32. As shown in FIG. 3, the outer surface 26 and inner diameter portion 30 form an annular side wall 34 for conduction of the magnetic field, as will be more fully set out later.

FIG. 3 further depicts the sleeve 36, and wherein the sleeve 36 is generally a cylindrical member that is concentrically disposed within the inner diameter portion 30. The sleeve 36 is constructed of the material selected from the group consisting of aluminum, copper, brass, plastics and alloys not having iron or tungsten. The sleeve 36 has an outer surface 38 that extends to the radial end 40, which in turn extends to the inner diameter surface 42. Note that the chamfered end 44 of the sleeve 36 will abut the radial surface 32 of the housing 22. Also, the radial end 40, in the most preferred embodiment, will be flush with the radial end 28.

A container 46 is concentrically disposed within the sleeve 36, and wherein the container 46 may also be referred to as cup 46. Container 46 is generally cylindrical and has an outer surface 48 that extends to the radial end 50. As seen in FIG. 3, the container 46 has an inner diameter portion 52 that extends to the radial surface 54 so that the container 46 has an open end 56 and the closed end, and wherein the container 46 further contains the top radial surface 58. The open end leads to the cavity 59. The outer surface 48 and inner surface 52 form annular side wall 60. The container 46, in the most preferred embodiment, may be selected from the group consisting of iron and steel alloys. FIG. 3 further depicts the magnet 62 which is disposed within the inner diameter surface 42 of the sleeve 36, and wherein the magnet abuts the radial surface 32 at one end (designated the north pole end "N") and abuts the radial surface 58 at the other end (designated the south pole end "S"). In the most preferred embodiment, the magnet 62 is cylindrical. Also, in the most preferred embodiment, the magnet material may is a rare earth permanent magnetic material such as neodymium, iron boron, and sumarium cobalt.

FIG. 3 further depicts the flow of magnetic lines, and more specifically, the arrow 64 within side wall 34 represents the magnetic field pathway generated by the north pole "N". The arrow 66 within side wall 60 represents the magnetic field pathway generated by the south pole "S". The toroidal magnetic field is formed about the distal end 40 of the sleeve 36 where the magnetic lines of flux from side wall 34 and side wall 60 meet, as shown by the letter "T". This torodial magnetic field "T" takes the shape of an annular ring similar to a sliced doughnut, wherein the annular ring magnetic field is well situated for retrieval of metal object in a tubular setting due to the annular nature of the wells and tools.

Figure 4:
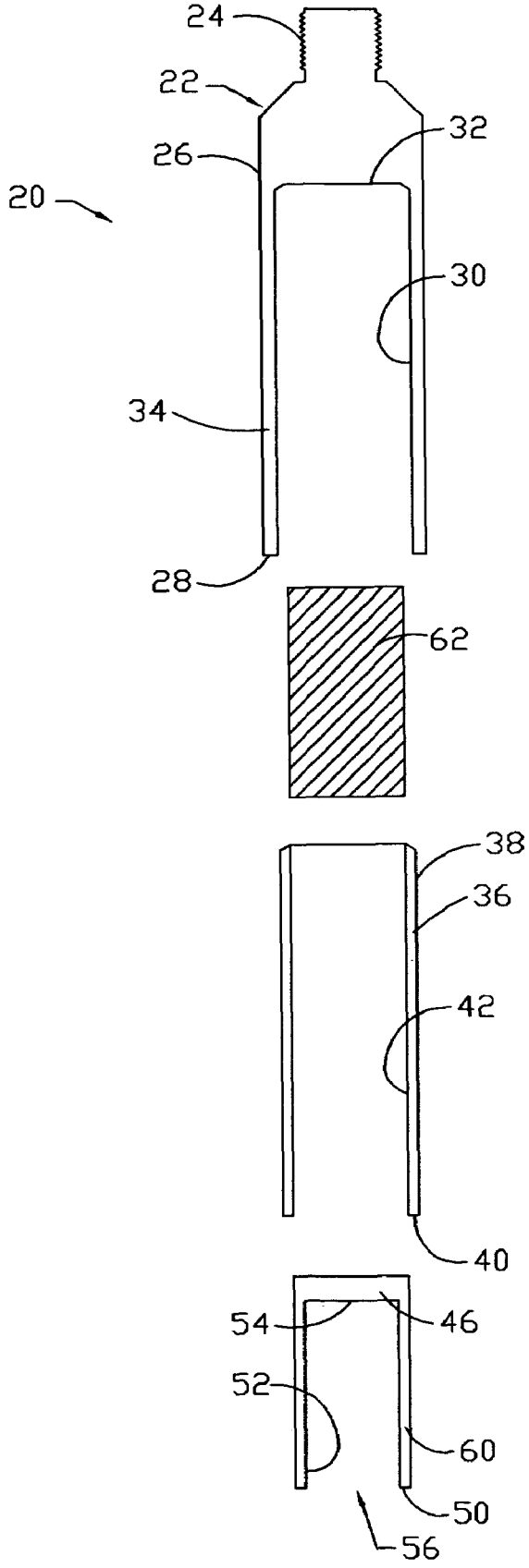
FIG. 4 is an exploded partial cross-sectional view of the preferred embodiment seen in FIG. 3.

Referring now to FIG. 4, an exploded partial cross-sectional view of the preferred embodiment seen in FIG. 3 will now be described. The housing 22 will have the sleeve 36 concentrically disposed therein, and wherein the magnet 62 will be disposed within the inner part of sleeve 36. The container 46 is generally cylindrical with the outer surface 48, and inner diameter surface 52 thereby forming side wall 60, wherein the container 46 has a closed end 54. The sleeve 36 is disposed within housing 22, and wherein the housing 22 contains the outer surface 26 and the inner diameter portion 30 so that the annular side wall 34 is formed.

Figure 5:
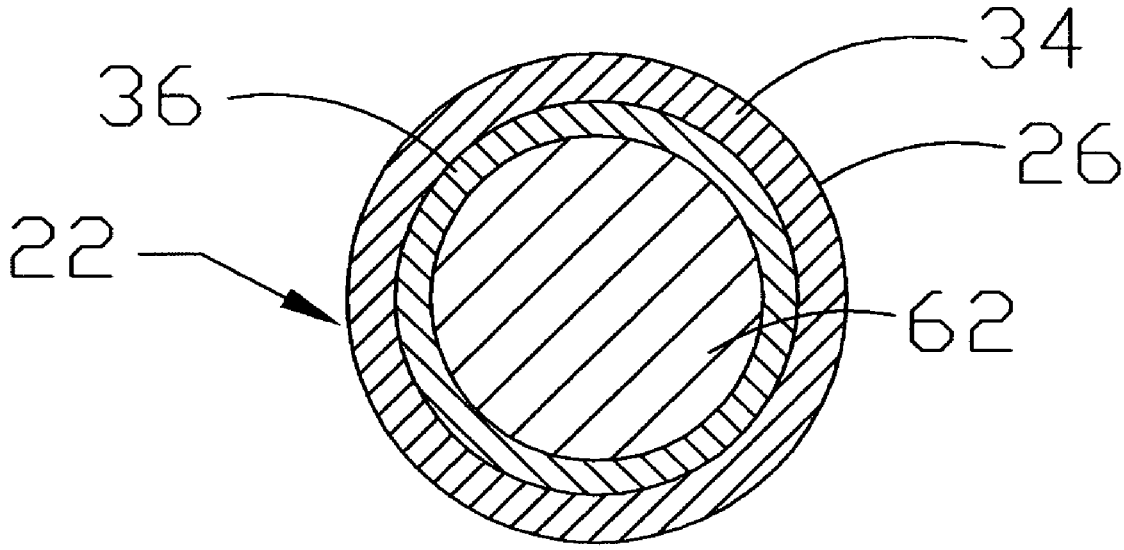
FIG. 5 is a cross-sectional view of the down hole apparatus seen in FIG. 3 taken along line 5-5.

Referring now to FIG. 5, the cross-sectional view of the down hole apparatus seen in FIG. 3 taken along line 5-5 depicts the housing 22 along with the outer surface 26. FIG. 5 further illustrates the side wall 34, with the sleeve 36 concentrically disposed within the housing 22. The magnet 62 is disposed within the sleeve 36 as previously described.

Figure 6:
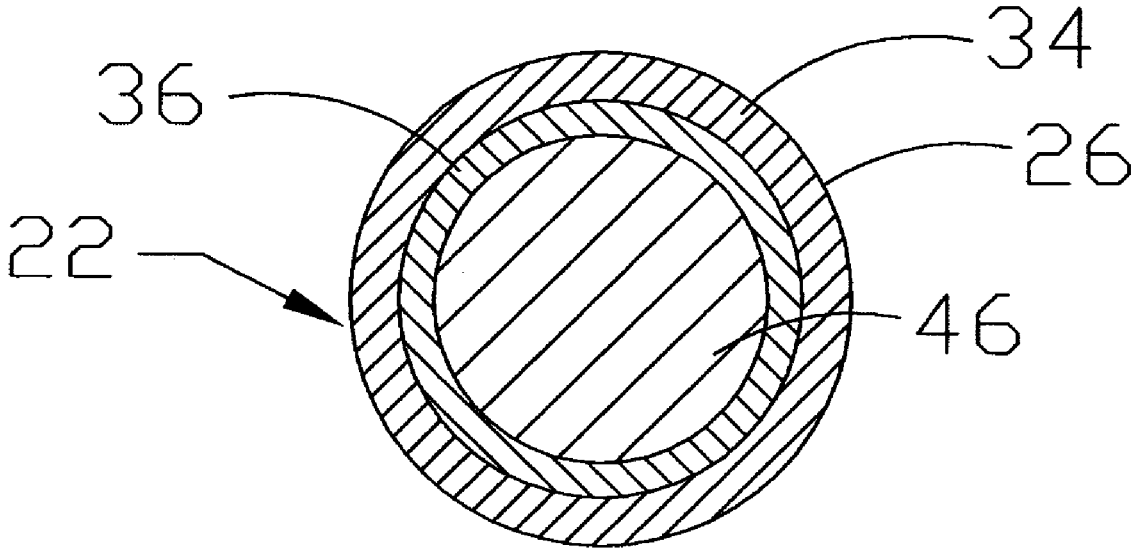
FIG. 6 is a cross-sectional view of the down hole apparatus seen in FIG. 3 taken along line 6-6.
Figure 7:
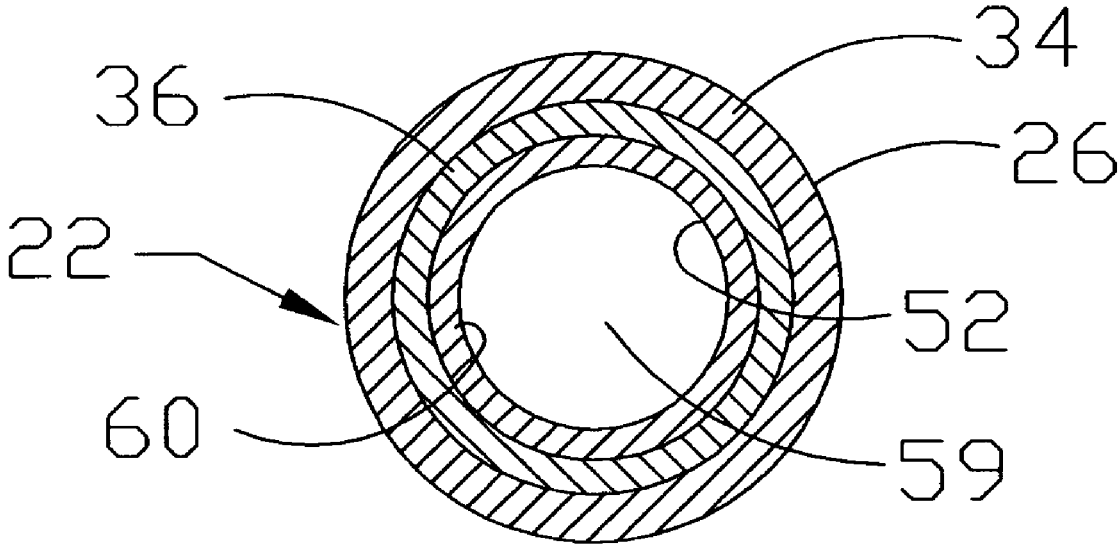
FIG. 7 is a cross-sectional view of the down hole apparatus seen in FIG. 3 taken along line 7-7.

In FIG. 6, which is a cross-sectional view of the down hole apparatus seen in FIG. 3 taken along line 6-6, the side wall 34 of housing 22 is depicted. The container 46, and in particular the closed end of the container 46 is shown concentrically disposed within the sleeve 36. FIG. 7 is a cross-sectional view of the down hole apparatus seen in FIG. 3 taken along line 7-7. FIG. 7 depicts the side wall 34 of housing 22, as well as the sleeve 36. FIG. 7 further depicts the side wall 60 of the container, and wherein the inner diameter portion 52 and cavity 59 is shown.

Figure 8:
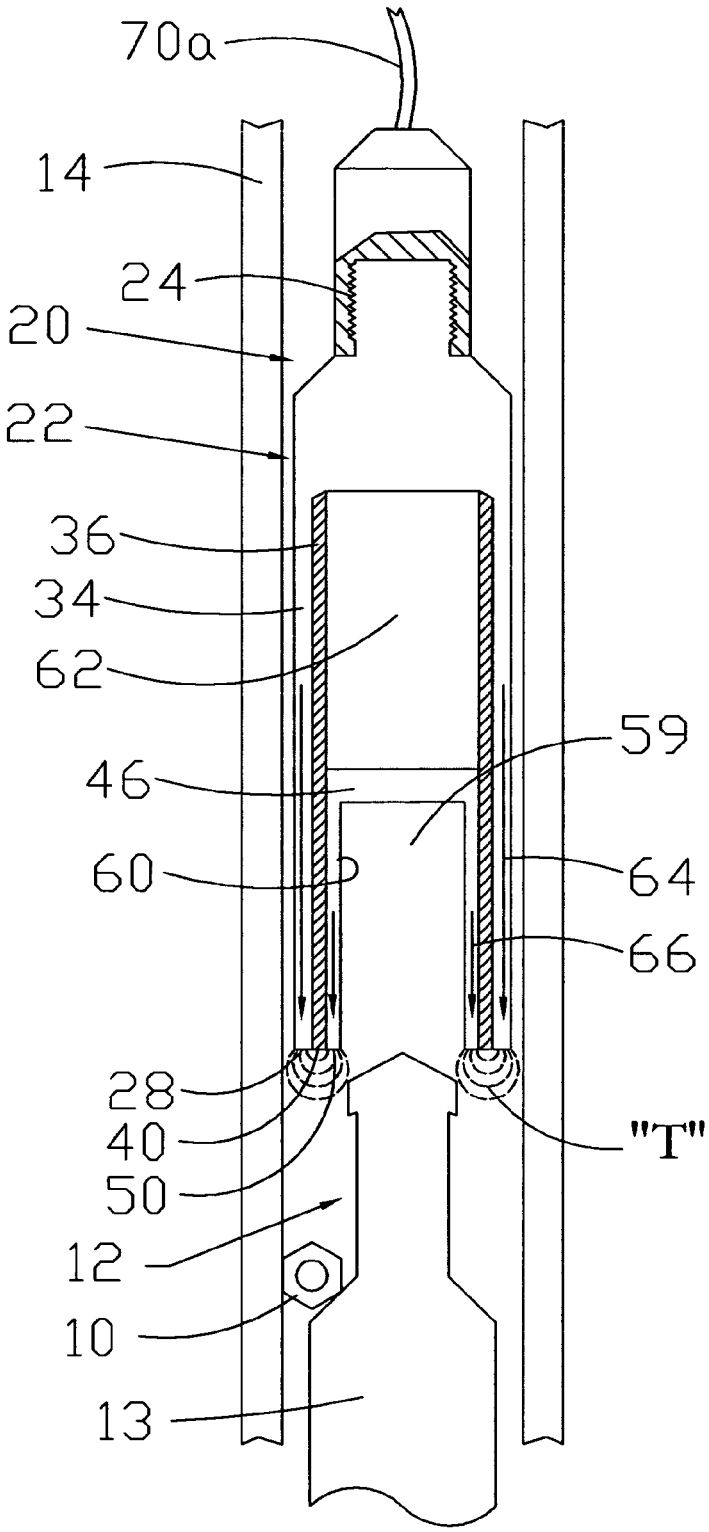
FIG. 8 is a partial cross-sectional view of the preferred embodiment of the down hole apparatus seen in FIG. 3 being lowered into a well bore having a fish.

Referring now to FIG. 8, a partial cross-sectional view of the preferred embodiment of the down hole apparatus 20 seen in FIG. 3 being lowered into a well bore 14 having a metal object 10 (herein after referred to as the fish). The fish 10 is positioned on fishing neck 12 of a down hole tool 13, as seen in FIG. 8. The apparatus 20 is being lowered on a work string, and wherein the work string may be a wire line string (70*a* seen in FIG. 8), or a coiled tubing string (70*b* seen in FIG. 9), or a tubular. Returning to FIG. 8, note that the toroidal magnetic field is represented by the magnetic flux lines "T" formed by the first side wall 34 (see arrow 64) as well as the second side wall 60 (see arrow 66). FIG. 8 depicts flush radial ends 28, 40, 50, thereby forming the toroidal flux lines "T".

Figure 9:
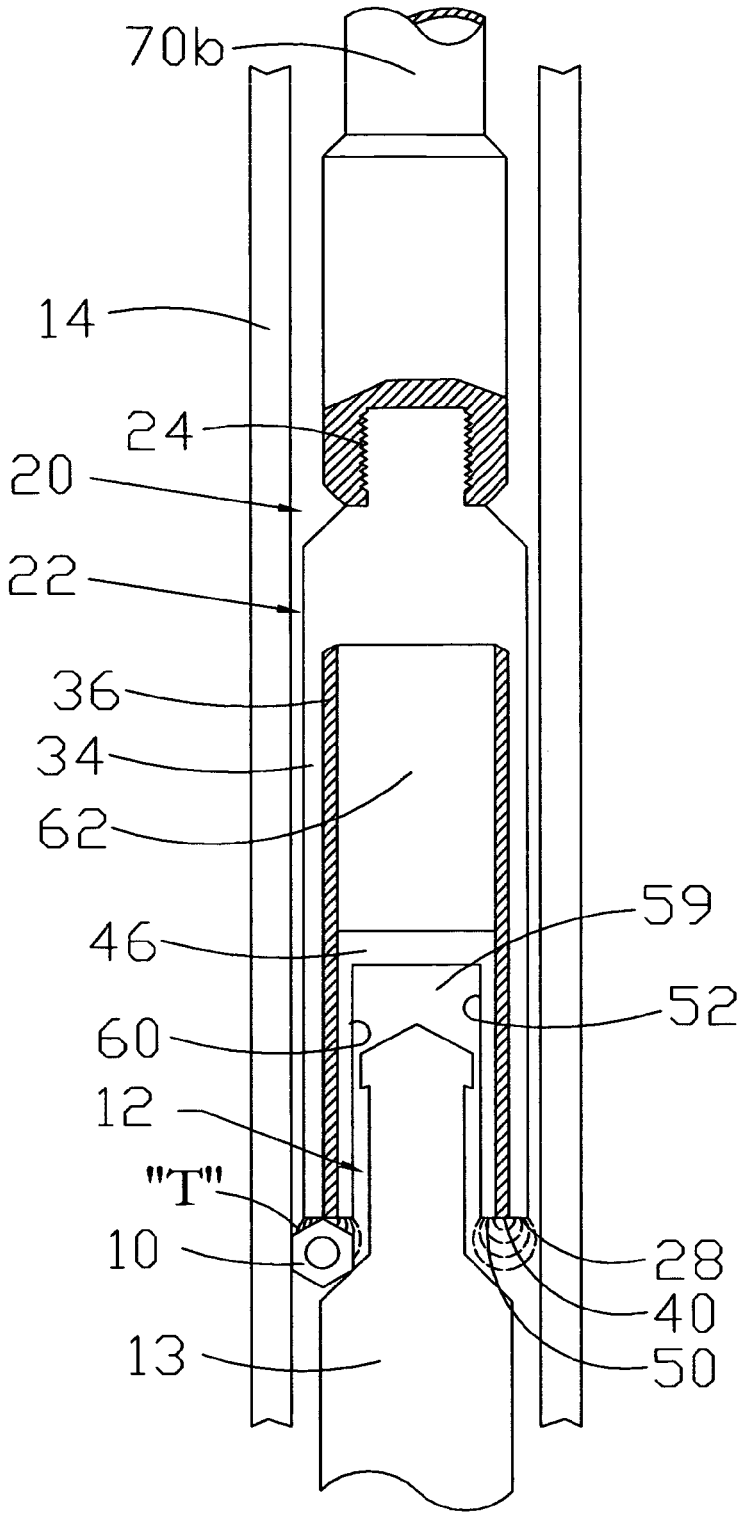
FIG. 9 is a partial cross-sectional sequential view taken from FIG. 8 with the toroidal magnetic field in contact with the fish.

FIG. 9 is a partial cross-sectional sequential view taken from FIG. 8 with the toroidal magnetic field "T" in contact with the fish 10. The fishing neck 12 has entered the inner diameter portion 52, and in particular the cavity 59, of the container 46 thereby allowing the fish 10 to come in contact with the toroidal magnetic field "T". As shown in FIG. 9, the open end of the container 46 defines the cavity 59 which can receive the fishing neck 12 of the down hole tool during the fishing operation. As noted earlier, the magnet 62 creates the magnet fields in side walls 34 and 60.

Figure 10:
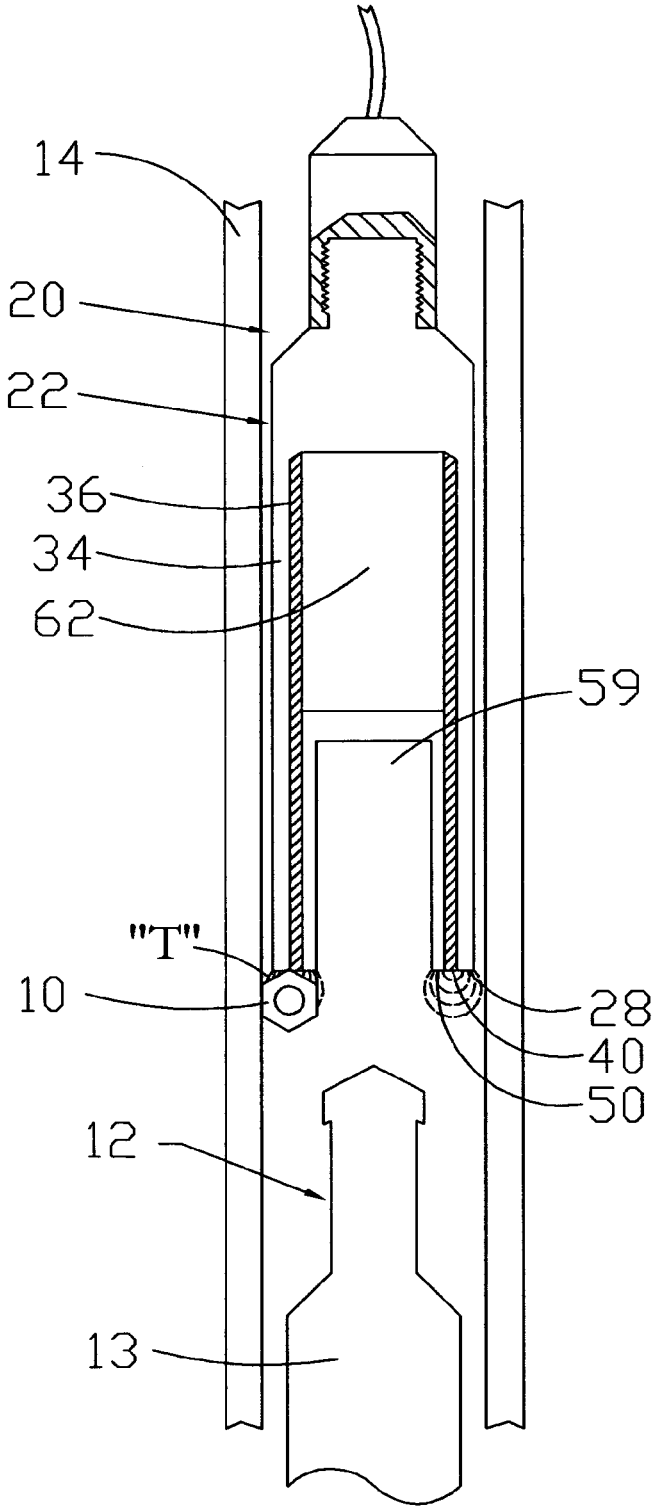
FIG. 10 is a partial cross-sectional sequential view taken from FIG. 8 with the fish being retrieved by the apparatus.

In FIG. 10, the down hole apparatus 20 is being pulled out of the well bore with the fish 10 attached thereto. Due to the design of the apparatus 20, the toroidal magnetic field "T" will magnetically couple the fish 10 to the radial ends 28, 40 and 50 of the housing 22, sleeve 36 and container 46, respectively. After the fish 10 is retrieved from the well bore 14, the operator can then run back into the well bore 14 with the proper retrieving tool in order to engage the fishing neck 12 and tool 13 for retrieval, as well understood by those of ordinary skill in the art.

The foregoing embodiments are presented by way of example only; the scope of the present invention is to be limited by the following claims and any equivalents thereof.

I claim:

1. An apparatus for retrieving a metal object comprising:

a cylindrical housing with an inner part, said housing having a first wall, wherein said housing has a radial open end and a closed end;

a sleeve concentrically disposed within said housing, said sleeve being constructed of a non-magnetic conduction material, said sleeve having a proximal end and a distal radial end;

a magnet disposed within said sleeve, said magnet having a north pole and a south pole;

a container disposed within said sleeve, said container having a second wall, wherein said container having a closed end and a radial open end, and wherein said open end defines a cavity, and wherein said radial open end of said housing, said distal radial end of said sleeve, and said radial open end of said container are flush;

wherein said first wall defines a first pathway for magnetic lines of flux for the north pole of the magnet and wherein said second wall defines a second pathway for magnetic lines of flux for the south pole of the magnet so that an annular magnetic field is formed about said flush radial open end of said housing, said distal radial end of said sleeve, and said radial open end of said container.

2. The apparatus of claim 1 wherein said magnet material is a rare earth permanent magnetic material selected from the group consisting of neodymium, iron boron, and sumarium cobalt.

3. The apparatus of claim 2 wherein said non-magnetic conduction material is selected from the group consisting of aluminum, copper, brass, plastics and alloys not having iron and tungsten.

4. The apparatus of claim 3 wherein said container material is selected from the group consisting of iron and steel alloys.

5. The apparatus of claim 4 wherein said housing is connected to a wire line string.

6. The down hole fishing apparatus of claim 4 wherein said housing is connected to a coiled tubing string.

7. A down hole fishing apparatus for use in a well bore, the down hole fishing apparatus comprising:

a cylindrical member with an inner part, said cylindrical member having a first cylindrical wall, wherein said cylindrical member has a radial open end and a closed end, and wherein said cylindrical member is constructed of iron;

a cylindrical sleeve concentrically disposed within said cylindrical iron member, said cylindrical sleeve being constructed of a non-magnetic conduction material said cylindrical sleeve having a distal radial end;

a magnet concentrically disposed within said cylindrical sleeve, said magnet having a north pole and a south pole;

a cup disposed within said cylindrical sleeve, said cup having a second cylindrical wall, wherein said cup having a closed end and radial open end, and wherein said radial open end of said housing, said distal radial end of said sleeve, and said radial end of said container are flush;

wherein said first cylindrical wall defines a first pathway for the north pole of the magnet and said second cylindrical wall defines a pathway for the south pole of the magnet said a toroidal magnetic field is formed about said flush radial open end of said housing, said distal radial end, and said radial open end of said container.

8. The down hole fishing apparatus of claim 7 wherein said non-magnetic conduction material is selected from the group consisting of aluminum, copper, brass, plastics and alloys not having iron or tungsten.

9. The down hole fishing apparatus of claim 8 wherein said magnet material is a rare earth permanent magnetic material selected from the group consisting of neodymium, iron boron, and sumarium cobalt.

10. The down hole fishing apparatus of claim 9 wherein said cup material is selected from the group consisting of iron and steel alloys.

11. The down hole fishing apparatus of claim 10 wherein said cylindrical member is connected to a wire line string.

12. The down hole fishing apparatus of claim 10 wherein said cylindrical member is connected to a coiled tubing string.

13. A method of retrieving a metal object within a well bore, the method comprising:

lowering a fishing apparatus into the well bore on a work string, said fishing apparatus comprising: a cylindrical housing with an inner part, said housing having a first wall and a radial end; a sleeve disposed within said housing and having a radial end, said sleeve being constructed of a non-magnetic conduction material; a magnet disposed within said sleeve, said magnet having a north pole and a south pole; a container disposed within said sleeve, said container having a second wall and a radial end, and wherein said radial ends of said housing, said sleeve, and said container are flush;

creating a first pathway for magnetic lines of flux for the north pole of the magnet, wherein said first pathway is formed from said first wall of said housing;

creating a second pathway for magnetic lines of flux for the south pole of the magnet, wherein said second pathway is formed from said second wall of said container;

generating an annular magnetic field about said radial ends of said housing, said sleeve, and said container;

lowering the fishing apparatus so that the toroidal magnetic field comes into contact with the object;

magnetically coupling the object to the apparatus due to the toroidal magnetic field.

14. The method of claim 13 wherein said non-magnetic conduction material is selected from the group consisting of aluminum, copper, brass, plastics and alloys not having iron or tungsten.

15. The method of claim 14 wherein said magnet material is a rare earth permanent magnetic material selected from the group consisting of neodymium, iron boron, and sumarium cobalt.

16. The method of claim 15 wherein said cup material is selected from the group consisting of iron and steel alloys.

17. The method of claim 16 wherein said housing is connected to a wire line string.

18. The method of claim 17 wherein said housing is connected to a coiled tubing string.

19. An apparatus for retrieving a metal object from a down hole tool having a fishing neck, the apparatus comprising:

a cylindrical housing with an inner part, said housing having a first wall, wherein said housing has an open end and a closed end;

a sleeve disposed within said housing, said sleeve being constructed of a non-magnetic conduction material, said sleeve having a proximal end and a distal end;

a magnet disposed within said sleeve, said magnet having a north pole and a south pole;

a container disposed within said sleeve, said container having a second wall, wherein said container having a closed end and an open end, and wherein said open end defines a cavity configured to receive the fishing neck of the down hole tool;

wherein said first wall defines a first pathway for magnetic lines of flux for the north pole of the magnet and wherein said second wall defines a second pathway for magnetic lines of flux for the south pole of the magnet so that an annular magnetic field is formed about the open end of said housing, the open end of said container, and the distal end of said sleeve.

* * * * *